US006890164B2

(12) United States Patent
Ogata et al.

(10) Patent No.: US 6,890,164 B2
(45) Date of Patent: May 10, 2005

(54) INTERNAL GEAR PUMP

(75) Inventors: Daisuke Ogata, Itami (JP); Naoki Inui, Itami (JP); Shinya Arinaga, Itami (JP); Harumitsu Sasaki, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 12 days.

(21) Appl. No.: 10/796,155

(22) Filed: Mar. 10, 2004

(65) Prior Publication Data

US 2004/0191101 A1 Sep. 30, 2004

(30) Foreign Application Priority Data

Mar. 25, 2003 (JP) ..... 2003-083028
May 7, 2003 (JP) ..... 2003-129339
Jan. 30, 2004 (JP) ..... 2004-024200

(51) Int. Cl.[7] ..... F03C 2/00

(52) U.S. Cl. ..... 418/150; 418/177; 418/166; 74/462

(58) Field of Search ..... 418/150, 171, 418/166; 74/462

(56) References Cited

U.S. PATENT DOCUMENTS 2,389,728 A * 11/1945 Hill ..... 418/166
2,421,463 A * 6/1947 Noreyko ..... 74/462
4,673,342 A * 6/1987 Saegusa ..... 418/150
5,813,844 A * 9/1998 Hosono et al. ..... 418/150
6,244,843 B1 6/2001 Kosuge

FOREIGN PATENT DOCUMENTS

| | | | | |
|---|---|---|---|---|
| EP | 0 785 360 A1 | | 7/1997 | |
| EP | 1 016 784 A1 | | 7/2000 | |
| JP | 61-210281 | | 9/1986 | |
| JP | 61210281 A | * | 9/1986 | ..... F04C/2/10 |
| JP | 61210283 A | * | 9/1986 | ..... F04C/2/10 |
| WO | WO 99/11935 | | 3/1999 | |

* cited by examiner

*Primary Examiner*—Theresa Trieu
(74) *Attorney, Agent, or Firm*—McDermott Will & Emery LLP

(57) ABSTRACT

A noise-reduced internal gear pump incorporating an inner rotor having an addendum formed by a smooth curve and a dedendum formed by a hypocycloid. The tooth profile of the outer rotor is determined by the following steps. The center Oi of an inner rotor 1 is revolved around the center Oo of the outer rotor so as to form a circle S having a diameter of 2e+t, where "e" is the amount of eccentricity between the inner and outer rotors and "t" is the maximum value of the interrotor clearance between the outer rotor and the inner rotor pressed against it. The inner rotor 1 is rotated on its axis 1/n times while its center Oi makes one revolution in the circular orbit S, where "n" is the number of teeth of the inner rotor. The envelope of the group of the tooth profile-curves of the inner rotor formed by its revolution is used as the tooth profile of the outer rotor.

6 Claims, 15 Drawing Sheets

Oil temperature: 40℃
Delivery pressure: 0.3MPa
Number of rotations: 3000rpm

Oil temperature: 40℃
Delivery pressure: 0.4MPa
Number of rotations: 3000rpm

Oil temperature: 100℃
Delivery pressure: 0.3MPa
Number of rotations: 3000rpm

Oil temperature: 100℃
Delivery pressure: 0.4MPa
Number of rotations: 3000rpm

INTERNAL GEAR PUMP

BACKGROUND OF THE INVENTION

1. Field of the Invention

The present invention relates to a noise-reduced internal gear pump that incorporates an inner rotor having an addendum formed by a smooth curve and a dedendum formed by a hypocyloid.

2. Description of the Background Art

The published Japanese patent application Tokuhyouhei 11-811935 has disclosed an internal gear pump that is intended to reduce the noise, improve the mechanical efficiency, and increase the pump life.

FIG. 11 shows the profile of the gear tooth of the internal gear pump disclosed in the Tokuhyouhei 11-811935. The pump combines an inner rotor having an addendum formed by an epicycloid and a dedendum formed by a hypocycloid (the tooth profile is shown in a dotted line) and an outer rotor having an addendum formed by a hypocycloid and a dedendum formed by an epicycloid (the tooth profile is shown in a solid line). An epicycloidal profile fh1 of the dedendum of the outer rotor is formed by the locus of one point on a first formation circle re1 that is circumscribed on a pitch circle P and rolls without slipping on the circle P from a starting point zO. An epicycloidal profile fh2 of the addendum of the inner rotor is formed by the locus of one point on a second formation circle re2 that is circumscribed on the pitch circle P and rolls without slipping on the circle P from a starting point zO'. A hypocycloidal profile fr1 of the addendum of the outer rotor is formed by the locus of one point on a third formation circle rh1 that is inscribed in the pitch circle P and rolls without slipping on the circle P from the starting point zO. A hypocycloidal profile fr2 of the dedendum of the inner rotor is formed by the locus of one point on a fourth formation circle rh2 that is inscribed in the pitch circle P and rolls without slipping on the circle P from the starting point zO'. The formation circles re1, re2, rh1, and rh2 have a different diameter. A clearance CR between the addendum of the outer rotor and the corresponding dedendum of the inner rotor is equal to the difference in diameter between the third and fourth formation circles rh1 and rh2. A clearance CR' between the dedendum of the outer rotor and the corresponding addendum of the inner rotor is equal to the difference in diameter between the first and second formation circles re1 and re2. When the amount of eccentricity between the outer and inner rotors is "e," the clearance between the two rotors at the position where the two rotors interlock with each other most closely is nearly equal to the clearance between the two rotors at the position where the two rotors interlock with each other most loosely.

An internal gear pump is required to have a clearance between the outer rotor and the inner rotor to enable the rotors to rotate smoothly. In the pump disclosed in the Tokuhyouhei 11-811935, the clearance is created by providing the difference in diameter between the first and second formation circles re1 and re2 and between the third and fourth formation circles rh1 and rh2. In this case, when the inner rotor is pressed against the outer rotor at the engaging portion, there exists a minimum clearance between each tooth of the inner rotor and the opposed tooth of the outer rotor. Hereinafter this minimum clearance is referred to as an "interrotor clearance" including the expression in the section "Claims." The present inventors found that when the pump is operated, the interrotor clearance increases abruptly from zero at the engaging portion, causing the noise.

SUMMARY OF THE INVENTION

An object of the present invention is to offer an internal gear pump in which an abrupt change in the interrotor clearance is eliminated to reduce the noise further.

According to the present invention, the foregoing object is attained by offering the following internal gear pump. The internal gear pump comprises:

(a) an inner rotor having an addendum formed by a smooth curve and a dedendum formed by a hypocycloid; and (b) an outer rotor.

The tooth profile of the outer rotor is determined by the following steps.

(b1) The center of the inner rotor is revolved around the center of the outer rotor so as to form a circle having a diameter of 2e+t, where "e" is the amount of eccentricity between the center of the inner rotor and the center of the outer rotor and "t" is the maximum value of the interrotor clearance between the outer rotor and the inner rotor pressed against the outer rotor.

(b2) The inner rotor is rotated on its own axis 1/n times while the center of the inner rotor makes one revolution in the circular orbit, where "n" is the number of teeth of the inner rotor.

(b3) The envelope of the group of the tooth-profile curves of the inner rotor formed by its revolution is drawn.

(b4) The envelope is used as the tooth profile of the outer rotor.

The above-described smooth curve forming the addendum of the inner rotor may be an epicycloid or a curve constituting a major portion of the upper half of an ellipse when its major axis is horizontally positioned.

According to one aspect of the present invention, the present invention offers the following internal gear pump. The internal gear pump comprises:

(a) an inner rotor having an addendum formed by a smooth curve and a dedendum formed by a hypocycloid; and (b) an outer rotor.

The smooth curve forming the addendum is modified by the following steps (in the following description, the same definition of the "e," "t," and "n" as above is applied, and hereinafter the same definition is applied).

(a1a) The center of a tentative inner rotor is revolved around the center of a tentative outer rotor so as to form a circle having a diameter of 2e+t.

(a1b) The tentative inner rotor is rotated on its own axis 1/n times while the center of the tentative inner rotor makes one revolution in the circular orbit.

(a1c) The envelope of the group of the tooth-profile curves of the tentative inner rotor formed by its revolution is drawn.

(a1d) The envelope is used as the tooth profile of the tentative outer rotor.

(a1e) By the use of the tooth profiles of the tentative inner and outer rotors, the position of the trailing end of a tooth face, necessary to close up the pump chamber, in the addendum of the tentative inner rotor is determined.

The tooth face has the leading end at the top of the addendum.

(a1f) The position of the tooth-engaging point where the tentative inner rotor engages the tentative outer rotor is determined.

(a1g) The position of another tooth face lying at the location from the position of the above-described trailing end to the tooth-engaging point is shifted to a place inside the curve forming the original tooth profile.

(a1h) The profile after the position modification is used as the tooth profile of the addendum of the inner rotor.

In the above description, the tooth-engaging point is the point nearest to the top of the addendum of the inner rotor in the inner rotor's tooth face that is pressed against the outer rotor to give the rotary force to it when the inner rotor forces the outer rotor to rotate.

The tooth profile of the outer rotor is determined by the following steps.

(b1) The center of the inner rotor, whose addendum has the tooth profile finally determined through the above-described steps, is revolved around the center of the outer rotor, whose tooth profile is to be finally determined, so as to form a circle having a diameter of 2e+t.

(b2) The inner rotor is rotated on its own axis 1/n times while the center of the inner rotor makes one revolution in the circular orbit.

(b3) The envelope of the group of the tooth-profile curves of the inner rotor formed by its revolution is drawn.

(b4) The envelope is used as the tooth profile of the outer rotor.

The above-described smooth curve forming the addendum of the inner rotor may be an epicycloid or a curve constituting a major portion of the upper half of an ellipse when its major axis is horizontally positioned.

As described above, the tooth profile of the outer rotor is formed through the following procedure. The inner rotor is revolved on the circle having a diameter of 2e+t. While the inner rotor makes one revolution, it is rotated on its own axis 1/n times. This operation produces a group of tooth-profile curves of the inner rotor. The envelope of the group is used to form the tooth profile of the outer rotor. In this case, the interrotor clearance increases gradually from zero to the maximum clearance produced between the top of the addendum of the outer rotor and the top of the addendum of the inner rotor. In other words, the amount of relative movement between the two rotors during the rotation is small. Consequently, the two rotors can rotate smoothly, producing only suppressed vibrations. As a result, the operation noise of the pump can be reduced in comparison with conventional pumps. The reduced vibration increases the pump life.

As one aspect of the invention, the present invention offers the following internal gear pump. The pump has an inner rotor whose tooth profile is modified by the following procedure. The envelope of the group of the tooth-profile curves of a tentative inner rotor formed by its revolution is used as the tooth profile of a tentative outer rotor. The use of the tooth profiles of the tentative inner and outer rotors determines the position to modify the tooth face of the addendum of the inner rotor. The pump has an outer rotor whose tooth profile is formed by the same procedure as described above by using the inner rotor whose tooth face is position-modified. The pump suppresses the mutual collision of the teeth of the outer and inner rotors at the non-engaging portion when the pump is operated. As a result, the pump further reduces the noise.

DETAILED DESCRIPTION OF THE INVENTION

Figure 1:
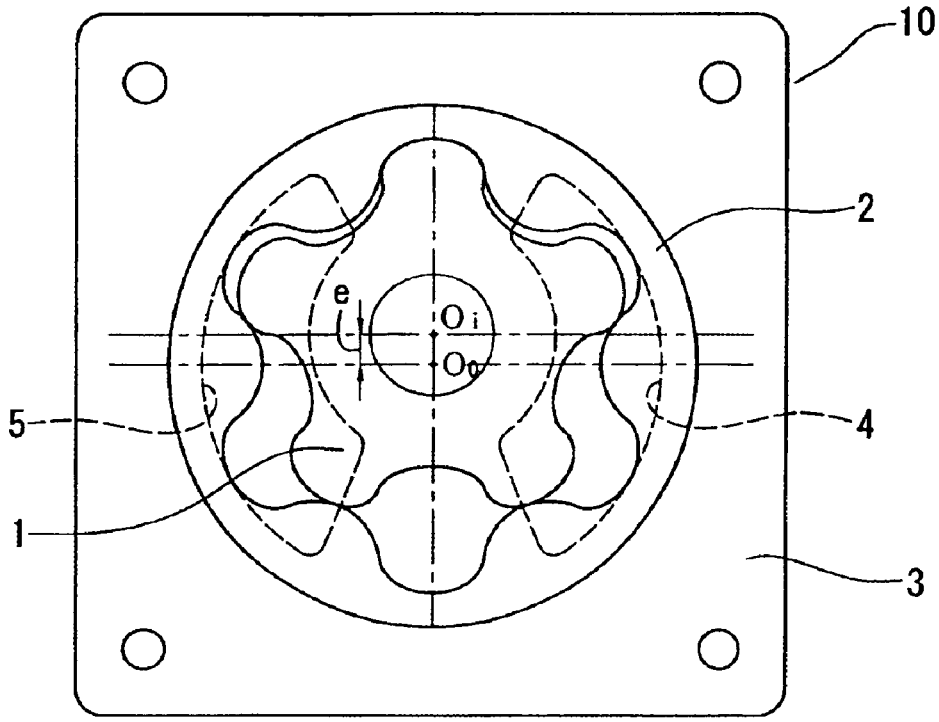
FIG. 1 is a schematic diagram showing an embodiment of the pump of the present invention, in which the cover of the pump is removed.

An embodiment of the present invention is explained below by referring to FIGS. 1 to 3. As shown in FIG. 1, an internal gear pump 10 comprises an inner rotor 1 of which the number of teeth is "n," an outer rotor 2 of which the number of teeth is "n+1," and a pump case (housing) 3 housing the two rotors. The pump case 3 is provided with a suction port 4 and a delivery port 5.

In the pump 10, the inner rotor 1 is a driving gear and the outer rotor 2 is a driven gear. The inner rotor 1 has a rotating center Oi, and the outer rotor 2 has a rotating center Oo. The centers Oo and Oi are eccentric to each other by the amount of "e."

Figure 11:
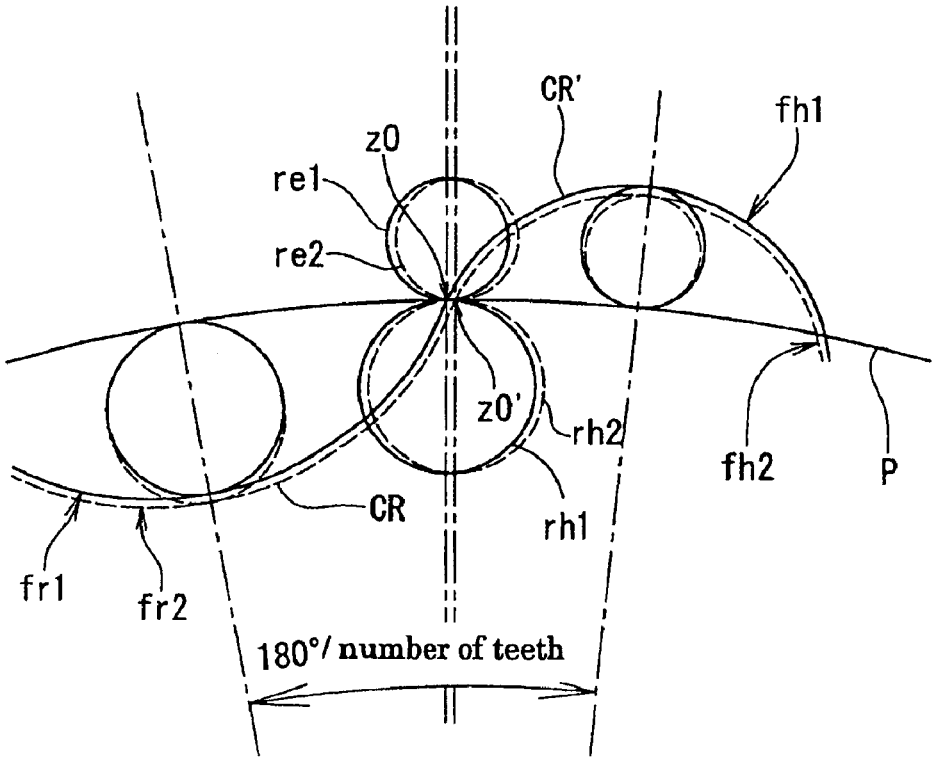
FIG. 11 PRIOR ART
FIG. 11 is a diagram showing the method of forming the profile of the gear tooth of the internal gear pump of a prior art.

The inner rotor 1 has a tooth profile explained by referring to FIG. 11. More specifically, the addendum has an epicycloidal profile formed by the locus of one point on the formation circle re2 that is circumscribed on the pitch circle P and rolls on the circle. The dedendum has a hypocycloidal profile formed by the locus of one point on the formation circle rh2 that is inscribed in the pitch circle P and rolls on the circle.

Figure 2:
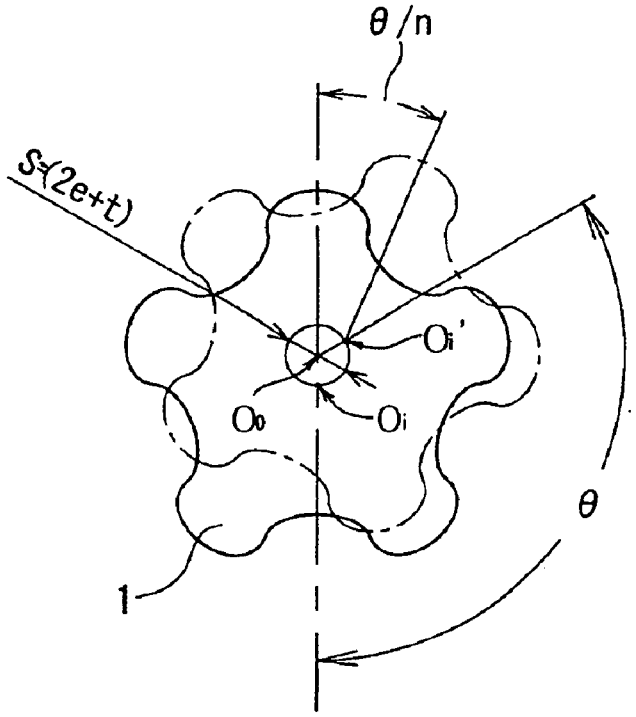
FIG. 2 is a diagram showing a shift of the tooth profile of the inner rotor when it is revolved while it is rotated on its own axis.
Figure 3:
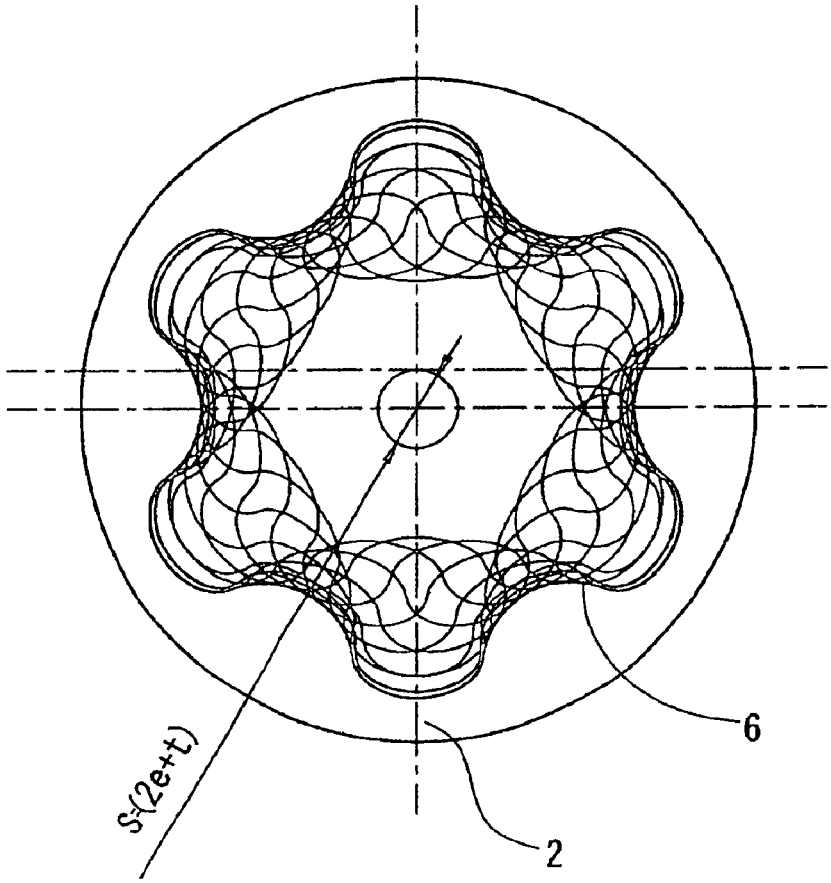
FIG. 3 is a diagram showing the tooth profile of the outer rotor formed by the envelope of the group of the tooth-profile curves of the inner rotor.

On the other hand, the outer rotor 2 has a tooth profile determined by the method illustrated in FIGS. 2 and 3. As shown in FIG. 2, the center Oi of the inner rotor 1 is revolved around the center Oo of the outer rotor 2 so as to form a circle S having a diameter of 2e+t, where "t" is the maximum value of the interrotor clearance between the outer rotor 2 and the inner rotor 1 pressed against the outer rotor 2 (see FIGS. 5A and 6A).

While the center Oi of the inner rotor 1 makes one revolution in the circular orbit S, the inner rotor 1 is rotated on its own axis 1/n times. ((360/n) degrees). Alternate long and short dashed lines in FIG. 2 show a tooth-profile curve of the inner rotor at the position when the center Oi of the inner rotor 1 revolves by an angle of θ degree around the center Oo of the outer rotor to shift to a point Oi' and concurrently the inner rotor 1 is rotated on its own axis by an angle of (θ/n) degrees. As shown in FIG. 3, the tooth-profile curve varies according to the revolution accompanied by the rotation. The group of the tooth-profile curves has an envelope 6, which is used to form the tooth profile of the outer rotor 2.

Figure 4:
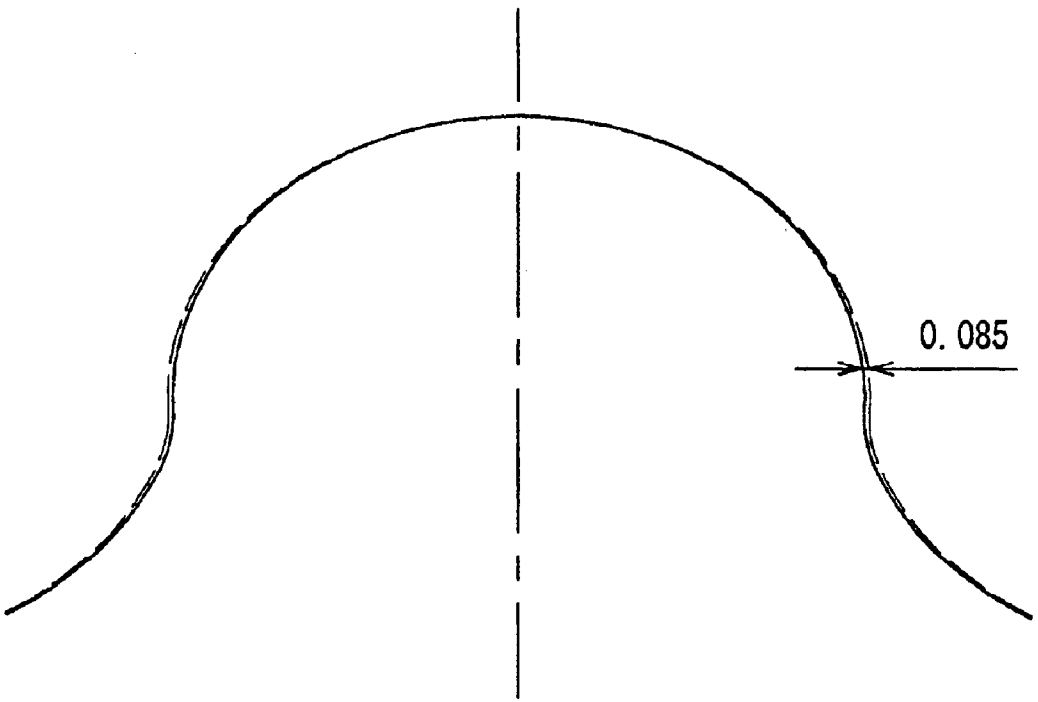
FIG. 4 is an enlarged diagram showing the difference in tooth profile between the outer rotor of the present invention and that of a prior art.

FIG. 4 is an enlarged diagram showing the difference in tooth profile between the outer rotor of the present invention formed by the envelope of the group of the tooth-profile curves of the inner rotor as explained by referring to FIGS. 2 and 3 and the outer rotor of a prior art formed by the method explained by referring to FIG. 11. In FIG. 4, the solid line shows the tooth profile of the pump of the present invention and the broken line shows that of a prior art. The two profiles differ with each other obviously in the vicinity of the boundary between the addendum and the dedendum.

Figure 5B:
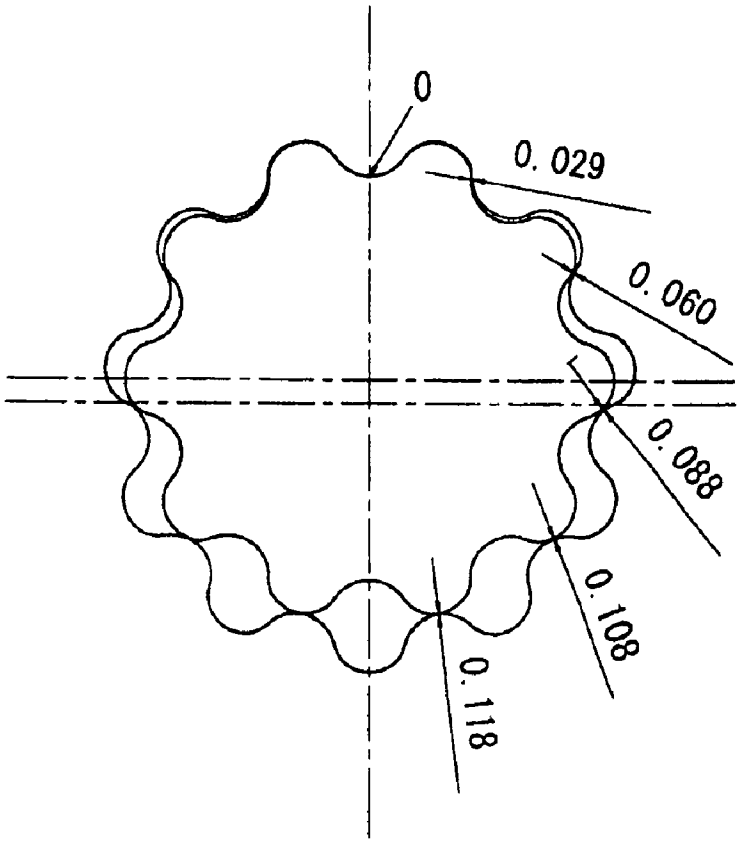
FIG. 5B is a diagram showing another example of the shift.
Figure 5A:
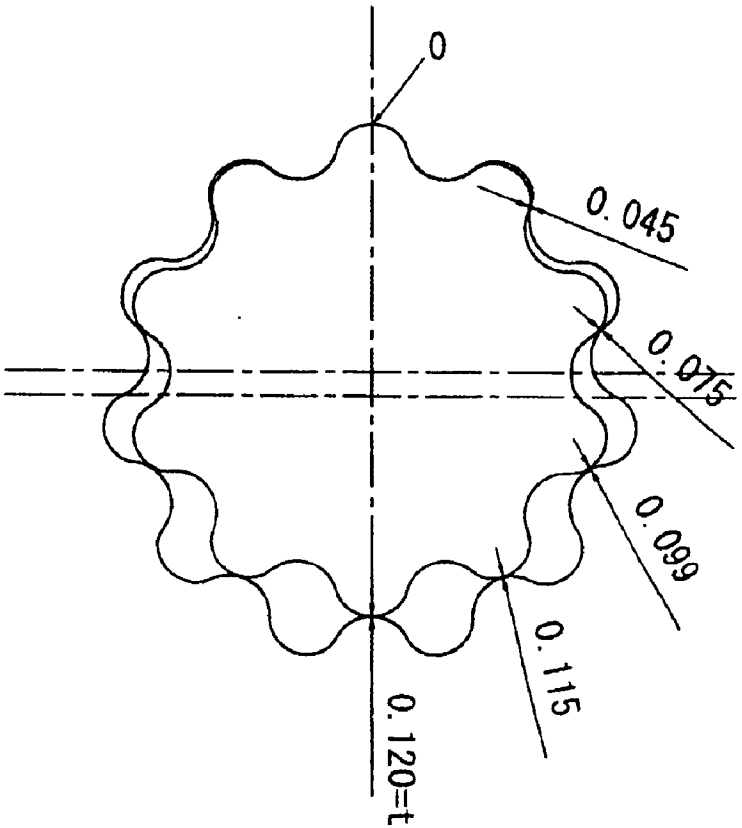
FIG. 5A is a diagram showing an example of the shift of the interrotor clearance of the pump having the tooth profile of the present invention.

FIGS. 5A and 5B show shifts of the interrotor clearance of the pump of the present invention when the inner rotor 1 and the outer rotor 2 each having the following features are combined:

Inner rotor:

Number of teeth: 10

Pitch circle: diameter: 62.00 (unit is mm, hereinafter the same is applied.)

Epicycloid formation circle: diameter: 3.10

Hypocycloid formation circle: diameter: 3.10

Outer rotor:

Number of teeth: 11

Amount of eccentricity between the two rotors: 3.10

Maximum value of the interrotor clearance: 0.12

Figure 6B:
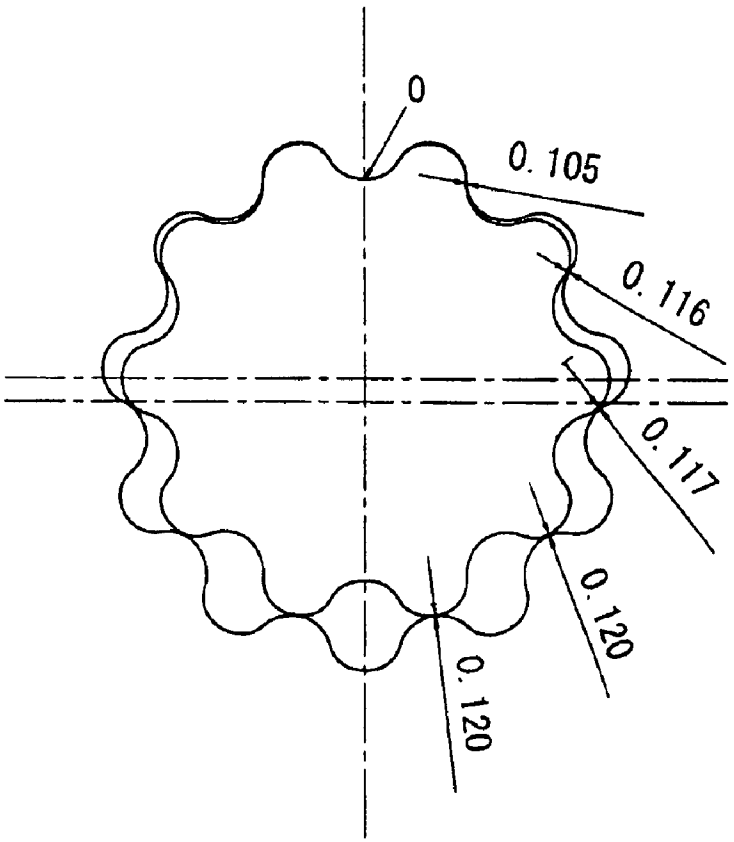
FIG. 6B PRIOR ART
FIG. 6B is a diagram showing another example of the shift.
Figure 6A:
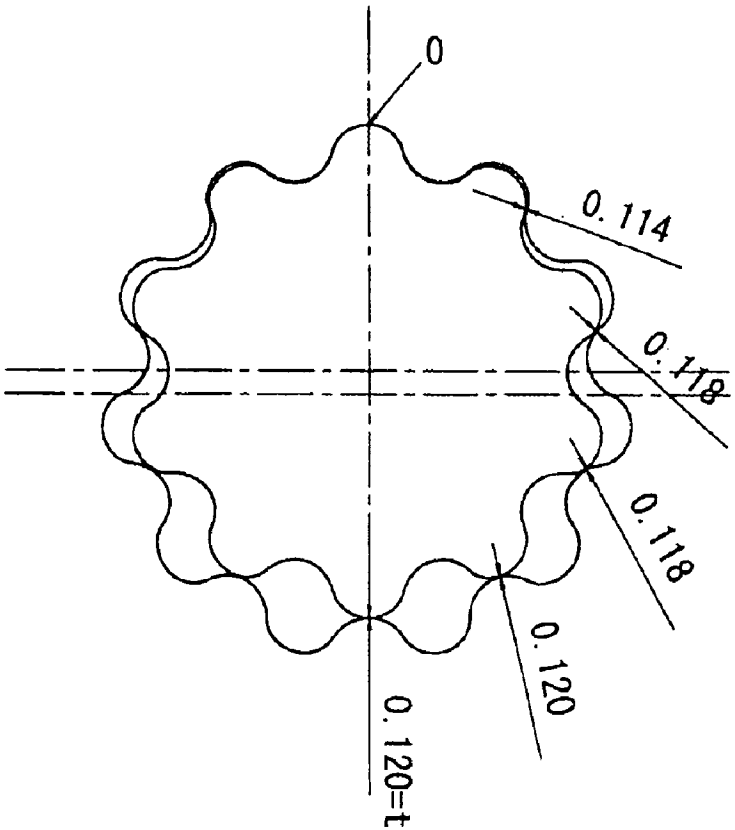
FIG. 6A PRIOR ART
FIG. 6A is a diagram showing an example of the shift of the interrotor clearance of the pump having the tooth profile of a prior art.

FIGS. 6A and 6B show shifts of the interrotor clearance of the pump of a prior art having the tooth profile formed by the method explained by referring to FIG. 11. The pump has the following features:

Inner rotor:

Number of teeth: 10

Pitch circle: diameter: 62.00 (unit is mm, hereinafter the same is applied.)

Epicycloid formation circle: diameter: 3.10

Hypocycloid formation circle: diameter: 3.10

Outer rotor:

Number of teeth: 11

Pitch circle: diameter: 68.20

Epicycloid formation circle: diameter: 3.04

Hypocycloid formation circle: diameter: 3.16

Amount of eccentricity between the two rotors: 3.10

FIGS. 5A and 6A show examples in which the position of zero interrotor clearance occurs at the position where the top of the addendum of the inner rotor 1 is coincident with the bottom of the dedendum of the outer rotor 2. FIGS. 5B and 6B show examples in which the position of zero interrotor clearance occurs at the position where the bottom of the dedendum of the inner rotor 1 is coincident with the top of the addendum of the outer rotor 2.

In the case of the tooth profile of the prior art, as shown in FIG. 6A, the interrotor clearance varies in the following order: 0→0.114→0.118→0.118→0.120→0.120 (unit is mm, hereinafter the same is applied). In FIG. 6B, the interrotor clearance varies in the following order: 0→0.105→0.116→0.117→0.120→0.120. In both cases, the interrotor clearance increases abruptly from zero.

In contrast, with the tooth profile of the present invention, as shown in FIG. 5A, the interrotor clearance varies in the following order: 0→0.045→0.075→0.099→0.115→0.120. In FIG. 5B, the interrotor clearance varies in the following order: 0→0.029→0.060→0.088→0.108→0.118. In both cases, the interrotor clearance varies mildly.

FIGS. 7A to 10B show the results of the measurement to compare the performance of the pump having the tooth profile of the present invention and the pump having the tooth profile of a prior art. The results are shown by the waveform of the vibration in the pump case while the rotors are rotating. FIGS. 7A to 10A show the waveform for the tooth profile of the present invention, and FIGS. 7B to 10B show that of the prior art. The pumps used in the comparison test combine the inner rotor 1 with 10 teeth and the outer rotor 2 with 11 teeth, whose tooth profiles are shown in FIGS. 5A to 6B.

Figure 7A:
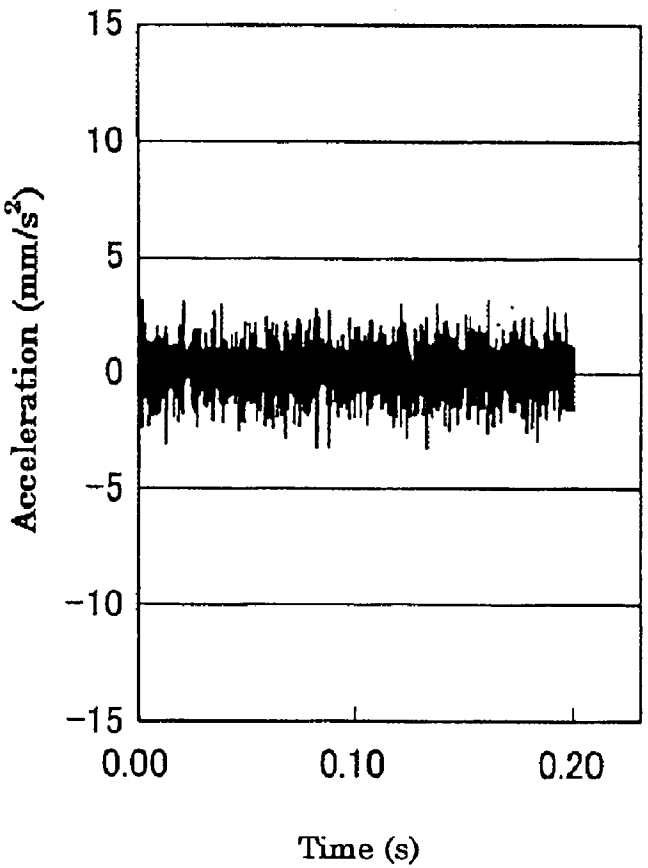
FIG. 7A is a chart showing the waveform of the vibration in the pump case of the pump having the tooth profile of the present invention while the rotors are rotating under a certain condition, and, for comparison.
Figure 7B:
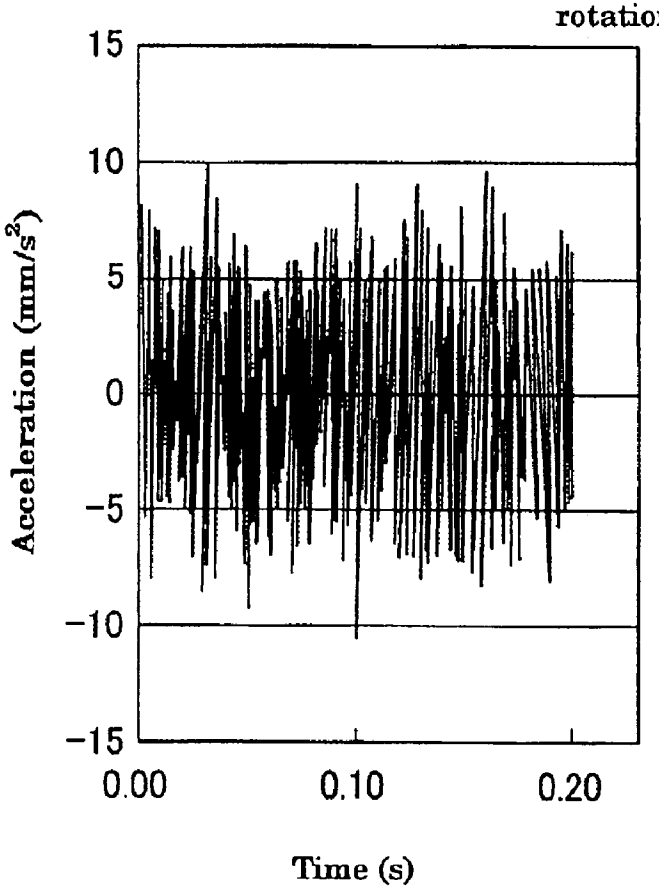
FIG. 7B is of the pump having the tooth profile of a prior art while the rotors are rotating under the same condition as in FIG. 7A.

FIGS. 7A and 7B show the test results under the following conditions: oil temperature: 40° C., delivery pressure: 0.3 MPa, and number of rotations: 3,000 rpm.

Figure 8A:
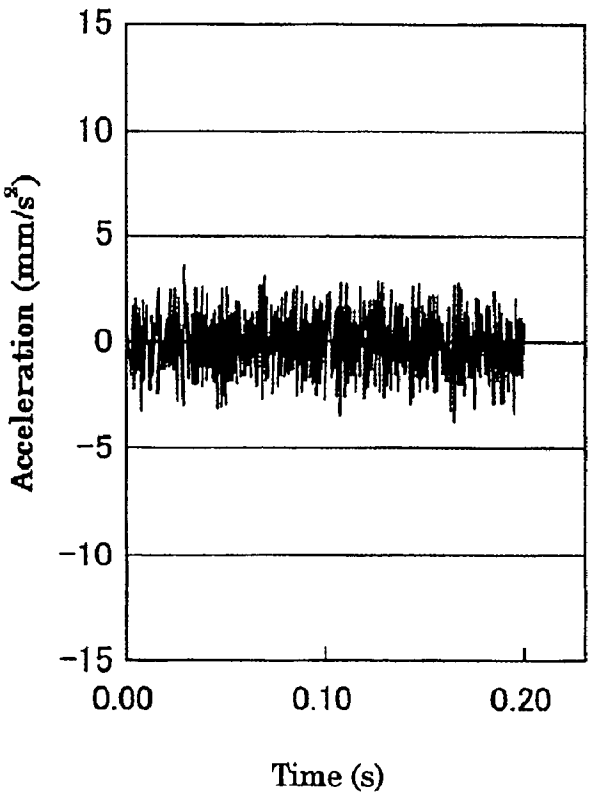
FIG. 8A is a chart showing the waveform of the vibration in the pump case of the pump having the tooth profile of the present invention while the rotors are rotating under another condition, and, for comparison.
Figure 8B:
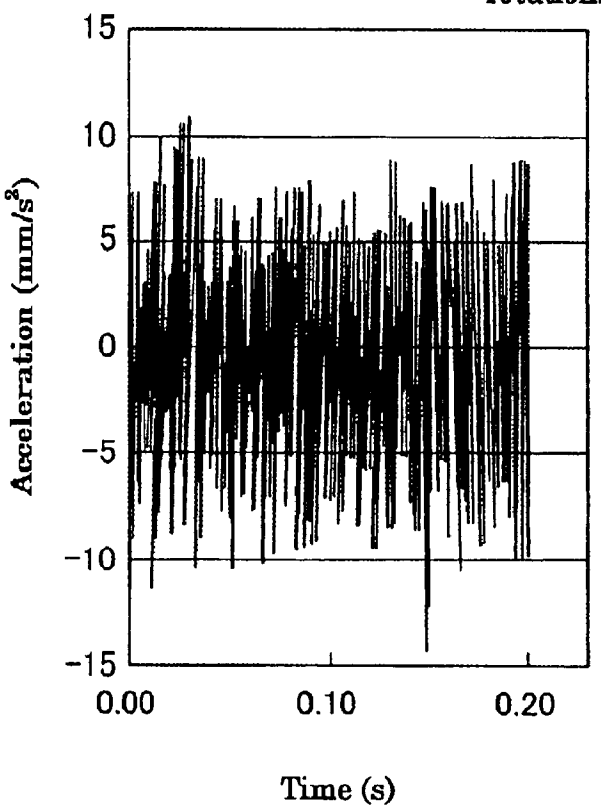
FIG. 8B is of the pump having the tooth profile of a prior art while the rotors are rotating under the same condition as in FIG. 8A.

FIGS. 8A and 8B show the test results under the following conditions: oil temperature: 40° C., delivery pressure: 0.4 MPa, and number of rotations: 3,000 rpm.

Figure 9A:
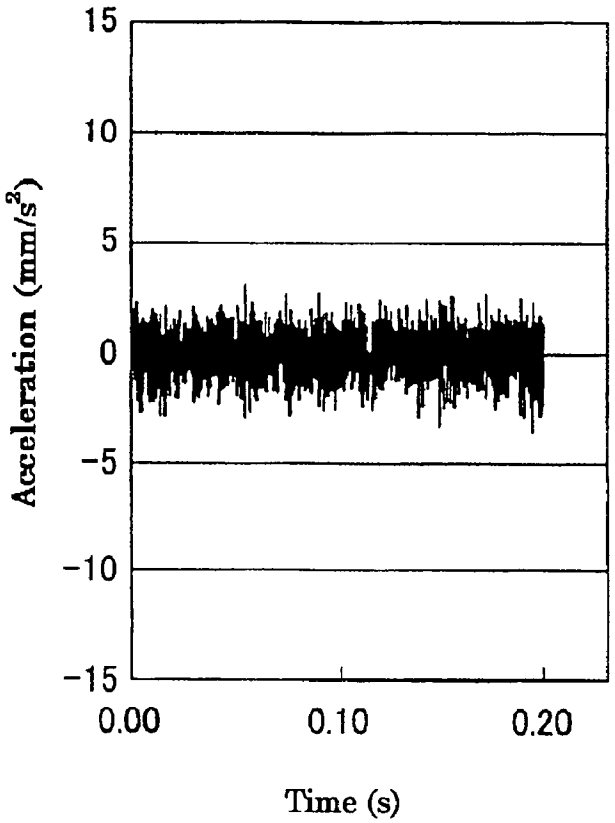
FIG. 9A is a chart showing the waveform of the vibration in the pump case of the pump having the tooth profile of the present invention while the rotors are rotating under yet another condition, and, for comparison.
Figure 9B:
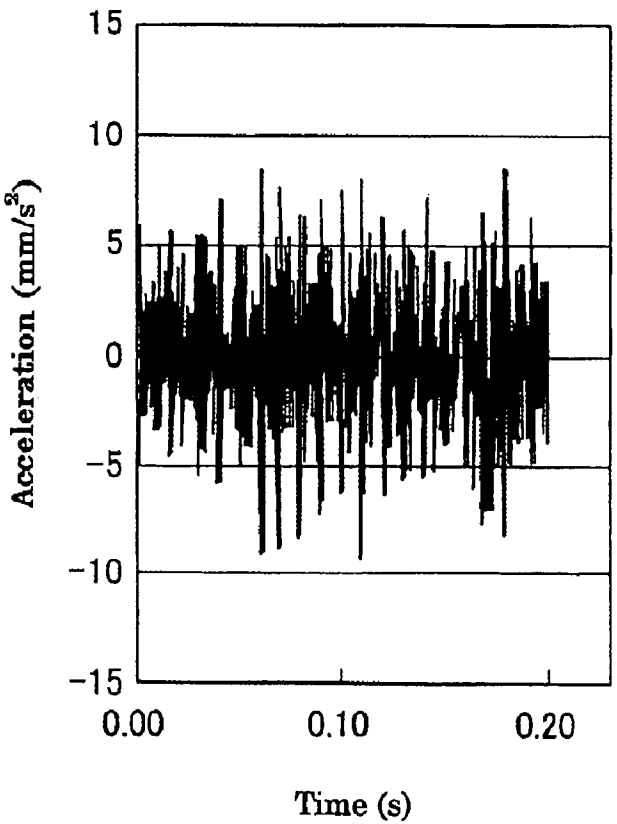
FIG. 9B is of the pump having the tooth profile of a prior art while the rotors are rotating under the same condition as in FIG. 9A.

FIGS. 9A and 9B show the test results under the following conditions: oil temperature: 100° C., delivery pressure: 0.3 MPa, and number of rotations: 3,000 rpm.

Figure 10A:
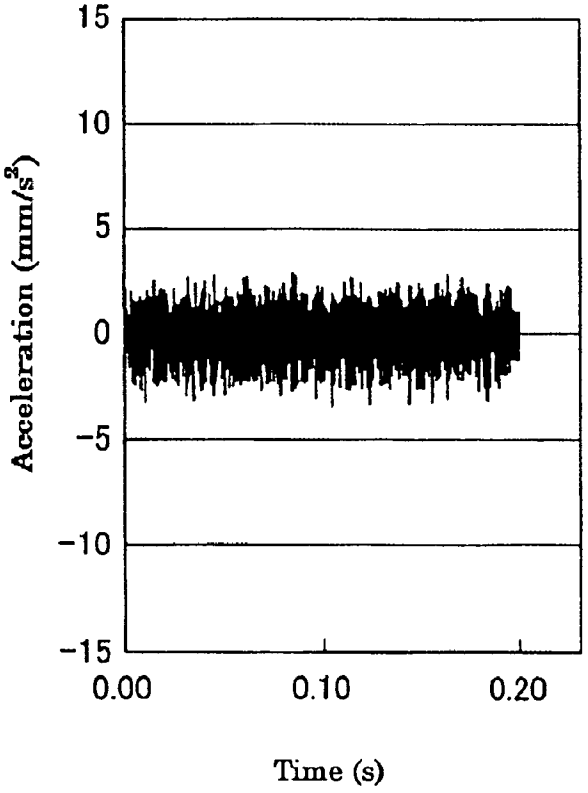
FIG. 10A is a chart showing the waveform of the vibration in the pump case of the pump having the tooth profile of the present invention while the rotors are rotating under yet another condition, and, for comparison.
Figure 10B:
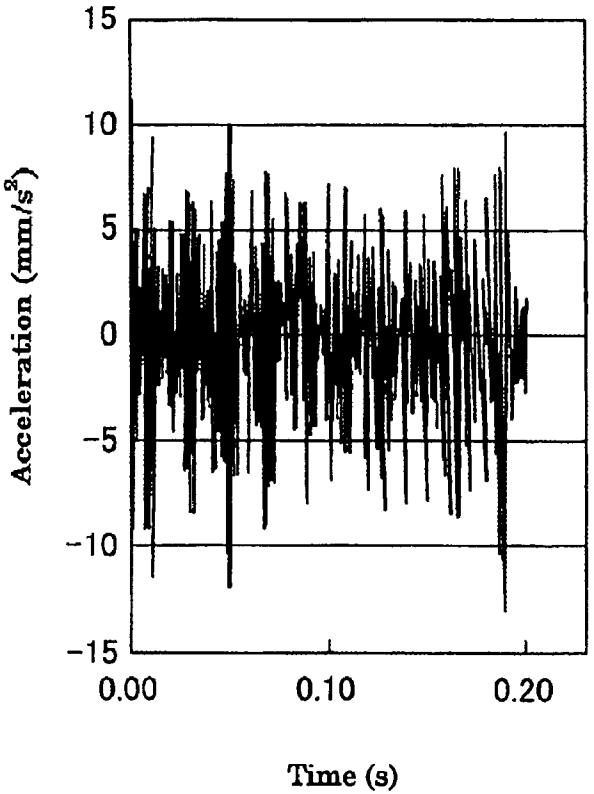
FIG. 10B is of the pump having the tooth profile of a prior art while the rotors are rotating under the same condition as in FIG. 10A.

FIGS. 10A and 10B show the test results under the following conditions: oil temperature: 100° C., delivery pressure: 0.4 MPa, and number of rotations: 3,000 rpm.

As can be seen from these results, the pump having the tooth profile of the present invention produces a smaller vibration under any of these conditions. As the vibration decreases, the produced noise decreases and the pump life is increased.

As explained above, the foregoing structure of the present invention eliminates the abrupt change in the interrotor clearance, so that the noise originated from the abrupt clearance change can be suppressed. However, the interrotor clearance increases gradually from zero to the maximum clearance produced by the top of the addendum of the outer rotor and the top of the addendum of the inner rotor. As a result, the teeth of the inner and outer rotors may collide against each other at the non-engaging portion, particularly at a portion where the interrotor clearance is small. It is possible that this collision will become a new source of noise.

Accordingly, the present invention also offers a measure to suppress the noise resulting from the collision (hereinafter referred to as "hitting") of the teeth at the non-engaging portion. The measure is effective even when the inner rotor has a tooth profile other than the cycloid.

Figure 12:
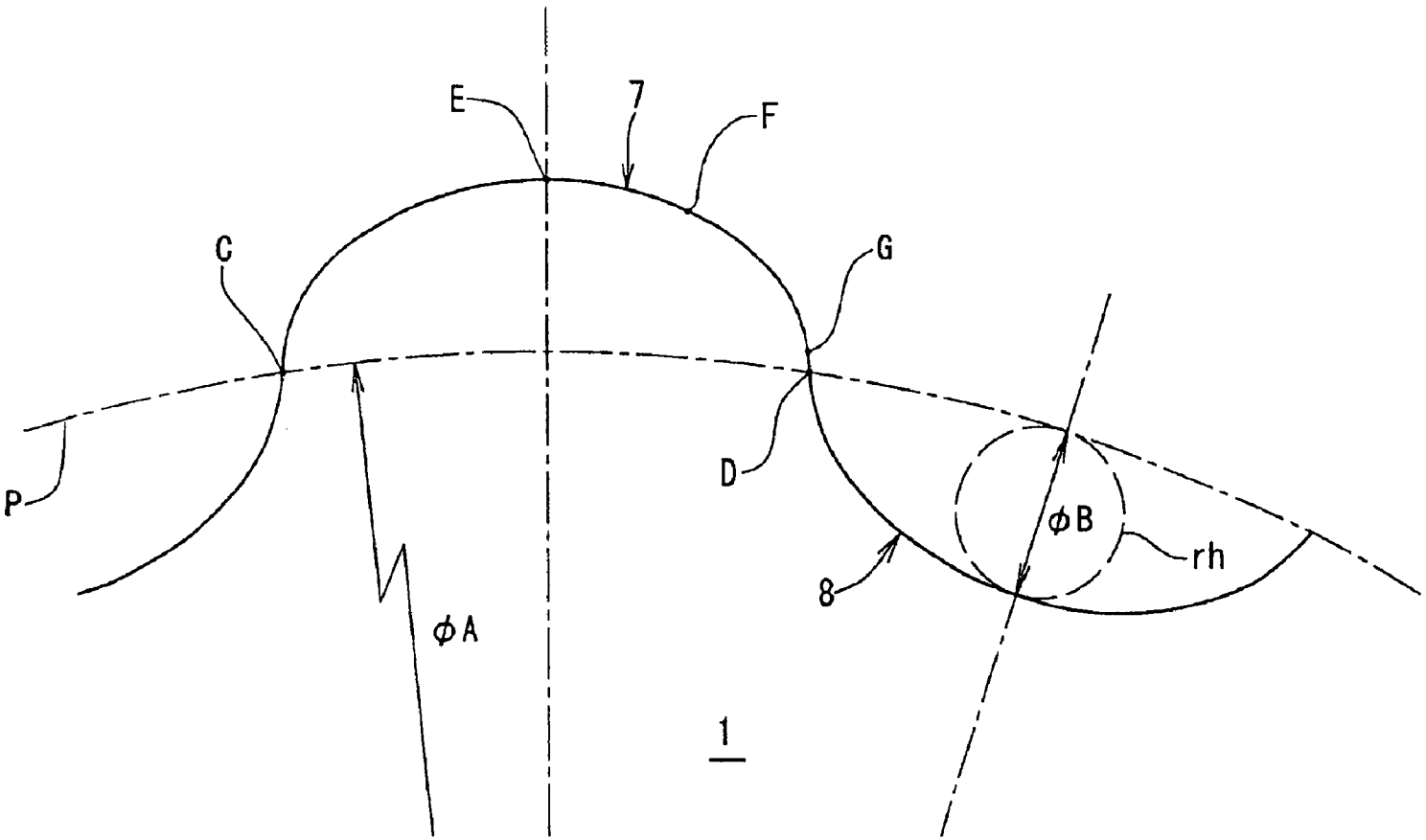
FIG. 12 is a diagram showing the tooth profile of the inner rotor having the addendum formed by a curve constituting a major portion of the upper half of an ellipse, in which the diagram shows the tooth face before it is modified.

The measure to suppress the hitting of the teeth at the non-engaging portion is explained below by referring to a concrete example. FIG. 12 shows the tooth profile of an inner rotor 1. The tooth profile has an addendum 7 formed by a curve constituting a major portion of the upper half of an ellipse when its major axis is horizontally positioned and a dedendum 8 formed by a hypocycloidal curve created by a formation circle (internally rolling circle) rh (diameter: B) that is inscribed in the pitch circle (base circle) P (diameter: A) and rolls on the circle P without slipping. The curve of the addendum 7 is center-symmetric, and its one end is connected to the trailing end of the curve of the dedendum 8 at a point C on the pitch circle P and the other end is connected to the starting end of the curve of the dedendum 8 at a point D on the pitch circle P.

When the inner rotor 1 has the tooth profile as shown in FIG. 12, the tooth profile of the outer rotor is formed through the following procedure. As explained by referring to FIGS. 2 and 3, the center of the inner rotor is revolved around the center of the outer rotor so as to form a circle having a diameter of 2e+t. While the center of the inner rotor makes one revolution in the circular orbit, the inner rotor is rotated on its own axis 1/n times. This operation produces a group of tooth-profile curves of the inner rotor. When the envelope of the group is used to form the tooth profile of the outer rotor, interrotor clearances at some non-engaging portions between the zero clearance and the maximum clearance produced by the top of the addendum of the outer rotor and the top of the addendum of the inner rotor can be made slightly wider than the original maximum clearance.

As a result, the noise originated from the abrupt change in interrotor clearance can be suppressed. In addition, the hitting of the teeth of the inner and outer rotors can also be suppressed because the interrotor clearance is increased at the non-engaging portion between the zero clearance and the maximum clearance produced by the two tops. However, the outer rotor has a sliding clearance with the pump case. Consequently, the center of the outer rotor tends to oscillate during the rotation. If the magnitude of the oscillation is greater than the interrotor clearance at some non-engaging portions, the hitting of the teeth of the two rotors cannot be suppressed sufficiently.

Figure 13:
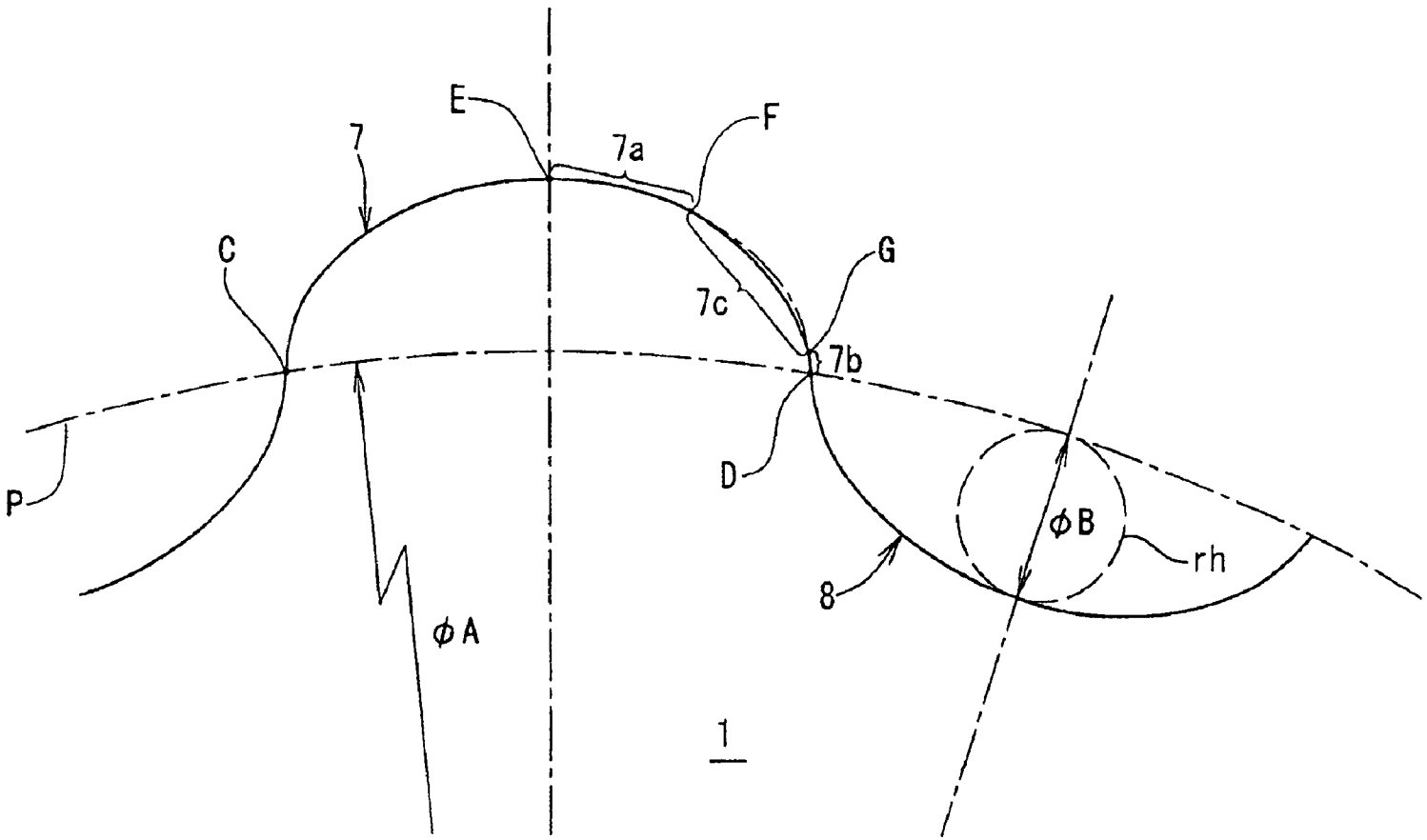
FIG. 13 is a diagram showing the tooth profile of the inner rotor having the addendum formed by a curve constituting a major portion of the upper half of an ellipse, in which the diagram shows the tooth face after it is modified.

To further prevent the foregoing tooth hitting, the following arrangement is employed. As shown in FIG. 13, a point F is determined as the trailing end of a tooth face 7*a* necessary to close up the pump chamber. A point G is determined as the tooth-engaging point. A tooth face 7*c* lying at the location from the point F to the point G is position-modified to a place shown in a solid line, which is located inside the original elliptical curve shown in alternate long and short dashed lines. The profile after the position modification is used as the tooth profile of the inner rotor. In FIG. 13, a point E is the top of the addendum, and points G and D are the leading end and the trailing end, respectively, of a tooth face 7*b* necessary to engage the outer rotor. As can be seen from FIG. 13, the position-modified tooth face 7*c* has a radius of curvature larger than that of the original elliptical curve. However, the radius is not limited to the one shown in FIG. 13.

The above-described modification of the tooth profile of the inner rotor and the subsequent determination of the tooth profile of the outer rotor to be combined with the tooth profile-modified inner rotor are performed by the following procedure.

First, the tooth profile of a tentative outer rotor is formed by using the envelope of the group of tooth-profile curves of a tentative inner rotor formed by its revolution. This formation method is explained below.

A tentative inner rotor whose tooth profile is unmodified is revolved around the center of a tentative outer rotor so as to form a circle having a diameter of 2e+t. While the center of the tentative inner rotor makes one revolution in the circular orbit, the tentative inner rotor is rotated on its own axis 1/n times. This operation produces a group of tooth-profile curves of the tentative inner rotor. The envelope of the group is used to determine the tooth profile of the tentative outer rotor.

Figure 14:
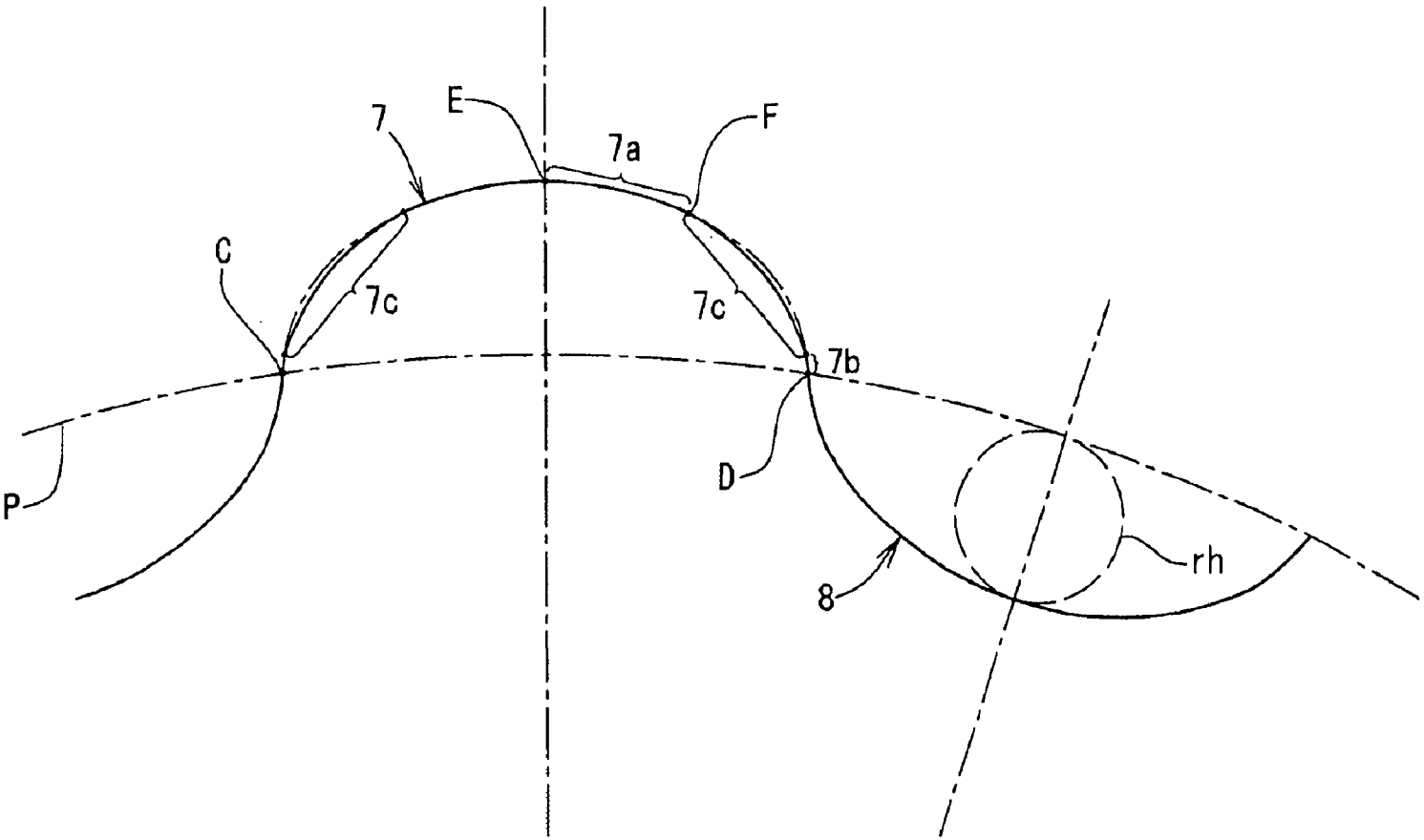
FIG. 14 is a diagram showing the tooth profile of the inner rotor in which the tooth face is modified in two locations: one location is ahead of the center of the curve forming the addendum when the rotor is rotated and the other is behind the center.

Next, the tooth profiles of the tentative inner and outer rotors are used to determine the position of the trailing end of the tooth face 7*a* of the inner rotor necessary to dose up the pump chamber (the position is denoted as the point F in FIGS. 12 to 14).

The tooth face 7*c* lying at the location from the trailing-end position, the point F, to the tooth-engaging point (the point G in FIGS. 12 to 14) is position-modified by shifting it to a place inside the curve forming the original tooth profile. The profile after the position modification is used as the tooth profile of the addendum of the inner rotor.

Subsequently, the center of the inner rotor whose addendum has the finally determined tooth profile is revolved around the center of the outer rotor whose tooth profile is to be finally determined so as to form a circle having a diameter of 2e+t. While the center of the inner rotor makes one revolution in the circular orbit, the inner rotor is rotated on its own axis 1/n times. This operation produces a group of tooth-profile curves of the inner rotor. The envelope of the group is used to finally determine the tooth profile of the outer rotor.

The modification of the position of the tooth face 7*c* is performed in at least one of the two locations: one location is ahead of the center of the curve forming the addendum 7 when the rotor is rotated and the other is behind the center. FIG. 14 shows the case in which the modification is performed in both locations.

The trailing end position F of the tooth face 7*a* needed to close up the pump chamber varies according to the position at which the pump chamber is disconnected from the suction port and the delivery port. There are two methods for the disconnection: one method disconnects the pump chamber from the suction port and the delivery port at the position where the pump chamber reaches the maximum volume and the other method disconnects the pump chamber from the suction port and the delivery port at the position where the volume of the pump chamber begins to decrease from the maximum value. The tooth face 7*a* has a smaller region in the latter case than in the former case.

Figure 15B:
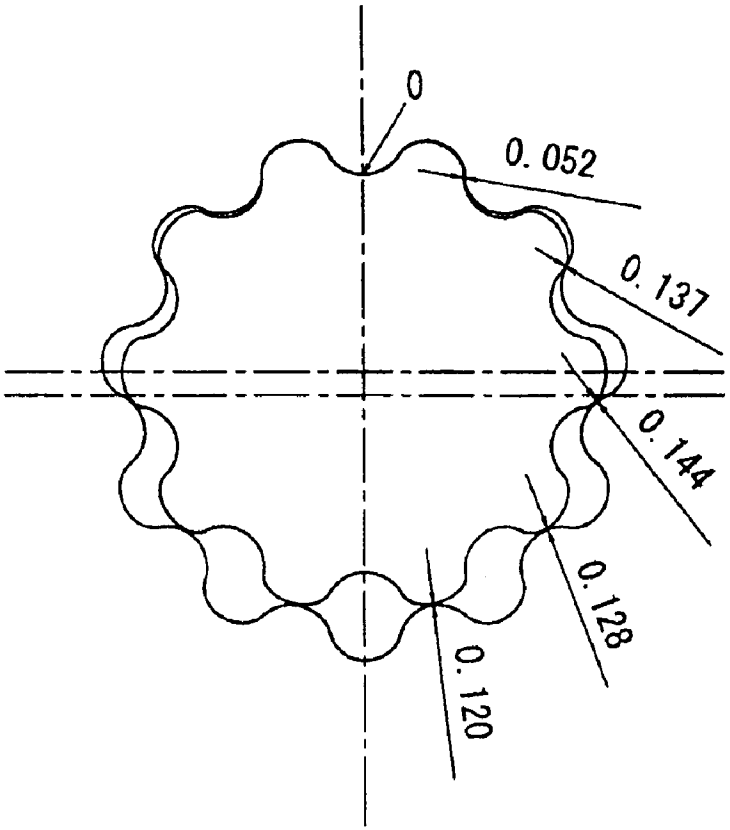
FIG. 15B is a diagram showing another example of the shift.
Figure 15A:
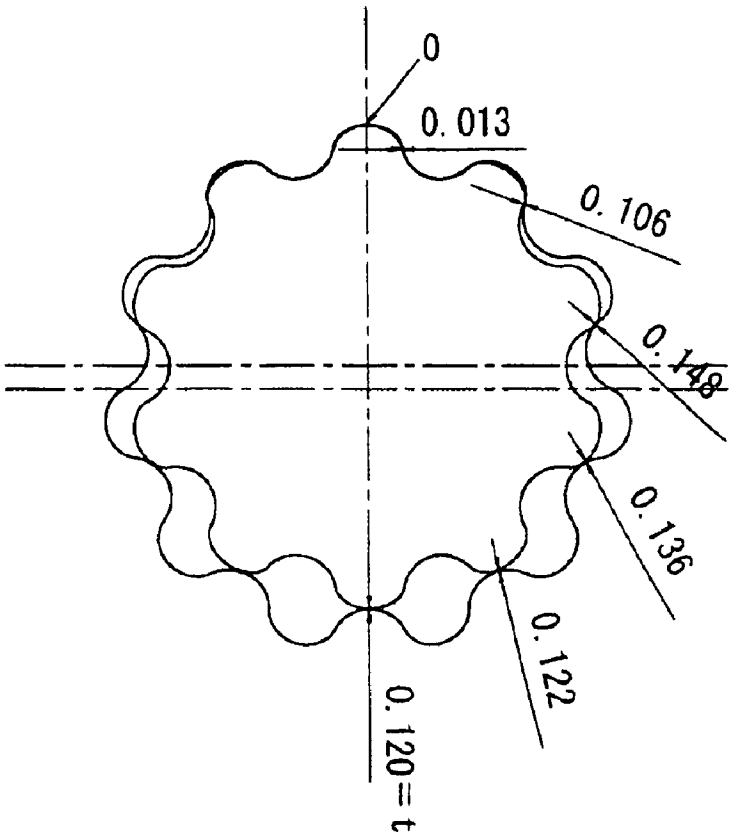
FIG. 15A is a diagram showing an example of the shift of the interrotor clearance before the tooth face is modified.
Figure 16B:
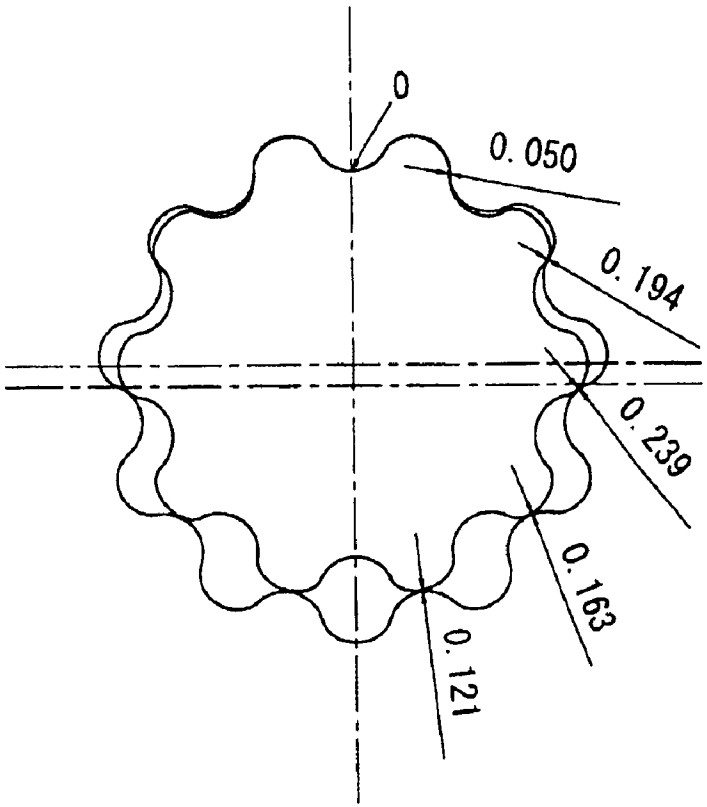
FIG. 16B is a diagram showing another example of the shift.
Figure 16A:
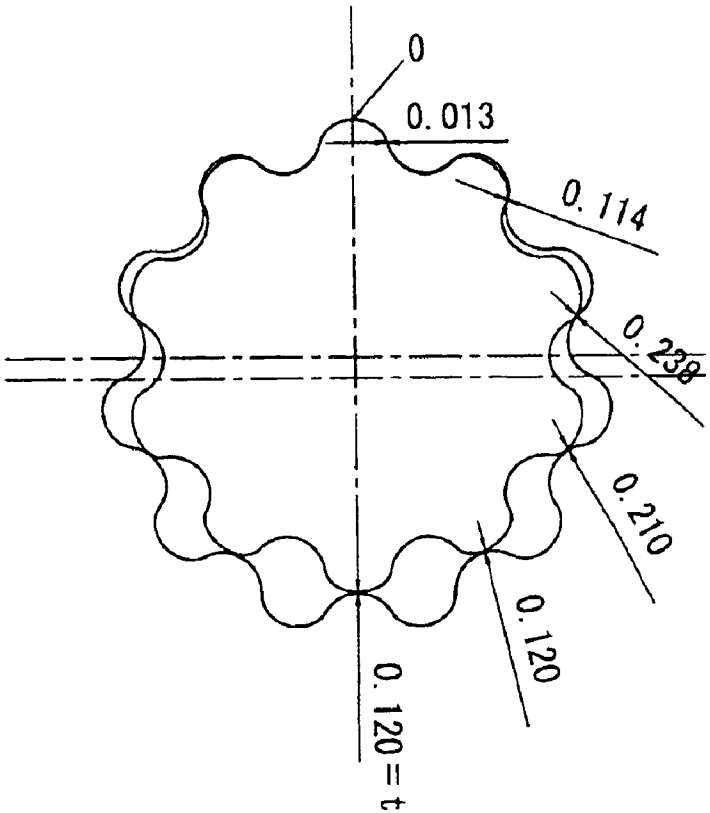
FIG. 16A is a diagram showing an example of the shift of the interrotor clearance after the tooth face is modified.

FIGS. 15A and 15B show shifts of the interrotor clearance of the pump before the tooth profile of the inner rotor is modified. FIGS. 16A and 16B show shifts of the interrotor clearance of the pump after the tooth profile of the inner rotor is modified.

The measurement of the shifts was performed by using the inner and outer rotors that have the following features:

Inner rotor:

Number of teeth: 10

Addendum circle: diameter: 68.20

Pitch circle: diameter: 62.00

Ellipse used for forming the addendum: half of the minor axis: 4.17655, half of the major axis: 4.91633

Hypocycloid formation circle for forming the dedendum: diameter: 3.10

Radius of curvature of the modified tooth face: 5.3

Outer rotor:

Number of teeth: 11

Amount of eccentricity between the two rotors: 3.10

Maximum value of the interrotor clearance: 0.12

FIGS. 15A and 16A show examples in which the position of zero clearance occurs at the position where the top of the addendum of the inner rotor is coincident with the bottom of the dedendum of the outer rotor. FIGS. 15B and 16B show examples in which the position of zero clearance occurs at the position where the bottom of the dedendum of the inner rotor is coincident with the top of the addendum of the outer rotor.

In the case of the tooth profile before it is modified, as shown in FIG. 15A, the interrotor clearance varies in the following order: 0→0.013→0.106→0.148→0.136→0.122→0.120. In FIG. 15B, the interrotor clearance varies in the following order: 0→0.052→0.137→0.144→0.128→0.120.

In contrast, with the tooth profile after it is modified, as shown in FIG. 16A, the interrotor clearance varies in the following order: 0→0.013→0.114→0.238→0.210→0.120→0.120. In FIG. 16B, the interrotor clearance varies in the following order: 0→0.050→0.194→0.239→0.163→0.121. As can be seen from these data, the clearance at the engaging portion and the interrotor clearance at the maximum clearance portion between the two tops have only a negligible difference from those shown in FIGS. 15A and 15B. However, the interrotor clearance at the other portions are considerably larger than those shown in FIGS. 15A and 15B. As a result, the modified tooth profile can not only prevent the abrupt increase in the interrotor clearance from the zero clearance in the engaging portion (and accompanying noise generation) but also suppress the tooth hitting in the non-engaging portion (and accompanying noise generation).

In the above-described embodiment, the inner rotor has the addendum with the profile formed by a curve constituting a major portion of the upper half of an ellipse. However, the profile is not limited to this type. Any profile having a smooth curve may be used, such as an epicycloidal curve, a trochoidal curve, or a spline curve.

What is claimed is:

1. An internal gear pump comprising:

(a) an inner rotor having an addendum formed by a smooth curve and a dedendum formed by a hypocycloid; and (b) an outer rotor having a tooth profile determined by the steps of:

(b1) revolving the center of the inner rotor around the center of the outer rotor so as to form a circle having a diameter of 2e+t, where "e" is the amount of eccentricity between the center of the inner rotor and the center of the outer rotor and "t" is the maximum value of the interrotor clearance between the outer rotor and the inner rotor pressed against the outer rotor;

(b2) rotating the inner rotor on its own axis 1/n times while the center of the inner rotor makes one revolution in the circular orbit, where "n" is the number of teeth of the inner rotor;

(b3) drawing the envelope of the group of the tooth-profile curves of the inner rotor formed by its revolution; and (b4) using the envelope as the tooth profile of the outer rotor (hereinafter the same definition of the "e," "t," and "n" as above is applied).

2. An internal gear pump as defined by claim 1, wherein the smooth curve forming the addendum of the inner rotor is an epicycloid.

3. An internal gear pump as defined by claim 1, wherein the smooth curve forming the addendum of the inner rotor is a curve constituting a major portion of the upper half of an ellipse when its major axis is horizontally positioned.

4. An internal gear pump comprising:

(a) an inner rotor having:

(a1) an addendum formed by a smooth curve modified by the steps of:

(a1a) revolving the center of a tentative inner rotor around the center of a tentative outer rotor so as to form a circle having a diameter of 2e+t;

(a1b) rotating the tentative inner rotor on its own axis 1/n times while the center of the tentative inner rotor makes one revolution in the circular orbit;

(a1c) drawing the envelope of the group of the tooth-profile curves of the tentative inner rotor formed by its revolution;

(a1d) using the envelope as the tooth profile of the tentative outer rotor;

(a1e) by using the tooth profiles of the tentative inner and outer rotors, determining the position of the trailing end of a tooth face, necessary to close up the pump chamber, in the addendum of the tentative inner rotor; the tooth face having the leading end at the top of the addendum;

(a1f) determining the position of the tooth-engaging point where the tentative inner rotor engages the tentative outer rotor;

(a1g) shifting the position of another tooth face lying at the location from the position of the above-described trailing end to the tooth-engaging point to a place inside the curve forming the original tooth profile; and (a1h) using the profile after the position modification as the tooth profile of the addendum of the inner rotor; and (a2) a dedendum formed by a hypocycloid; and (b) an outer rotor having a tooth profile determined by the steps of:

(b1) revolving the center of the inner rotor, whose addendum has the tooth profile finally determined through the above-described steps, around the center of the outer rotor, whose tooth profile is to be finally determined, so as to form a circle having a diameter of 2e+t;

(b2) rotating the inner rotor on its own axis 1/n times while the center of the inner rotor makes one revolution in the circular orbit;

(b3) drawing the envelope of the group of the tooth-profile curves of the inner rotor formed by its revolution; and (b4) using the envelope as the tooth profile of the outer rotor.

5. An internal gear pump as defined by claim 4, wherein the smooth curve forming the addendum of the inner rotor is an epicycloid.

6. An internal gear pump as defined by claim 4, wherein the smooth curve forming the addendum of the inner rotor is a curve constituting a major portion of the upper half of an ellipse when its major axis is horizontally positioned.

* * * * *